US012460645B2

(12) United States Patent
Krishnan et al.

(10) Patent No.: US 12,460,645 B2
(45) Date of Patent: Nov. 4, 2025

(54) HIGH EFFICIENCY DRILLING FLUID SHEARING PUMP USING STAGED TESLA TURBINE

(71) Applicant: Baker Hughes Oilfield Operations LLC, Houston, TX (US)

(72) Inventors: Aswath Krishnan, Spring, TX (US); Reza Ettehadi Osgouei, Spring, TX (US); Charles A. Thompson, Jr., Kingwood, TX (US); Jose Martinez, Spring, TX (US); Nils Kaageson-Loe, Claremore, OK (US)

( * ) Notice: Subject to any disclaimer, the term of this patent is extended or adjusted under 35 U.S.C. 154(b) by 0 days.

(21) Appl. No.: 18/481,614

(22) Filed: Oct. 5, 2023

(65) Prior Publication Data

US 2025/0116274 A1 Apr. 10, 2025

(51) Int. Cl.
*E21B 21/06* (2006.01)
*F04D 7/04* (2006.01)
*F04D 29/22* (2006.01)

(52) U.S. Cl.
CPC ..... *F04D 7/045* (2013.01); *E21B 21/062* (2013.01); *F04D 29/2288* (2013.01)

(58) Field of Classification Search
CPC ..... F04D 7/045; F04D 29/2288; E21B 21/062
See application file for complete search history.

(56) References Cited

U.S. PATENT DOCUMENTS 4,874,248 A 10/1989 Luetzelschwab
6,045,070 A * 4/2000 Davenport ..... F23G 5/033 241/101.8
6,219,301 B1 4/2001 Moriarty
6,581,859 B2 6/2003 Adams et al.
7,241,106 B2 * 7/2007 Avina ..... F01D 1/36 415/100
9,358,548 B2 * 6/2016 Barthelmess ..... B02C 13/30
9,447,313 B2 9/2016 Weinstein et al.
10,544,343 B2 1/2020 Ramesh et al.
10,695,729 B2 6/2020 Smith
2001/0011688 A1 * 8/2001 Whitlatch ..... B01F 33/83 241/101.8

(Continued)

FOREIGN PATENT DOCUMENTS

CN 108468534 B 8/2020
CN 112459847 A 3/2021

(Continued)

OTHER PUBLICATIONS

Embry-Riddle Aeronautical University, Introduction to Aerospace Flight Vehicles, Ch. 24 Boundary Layer Flows; accessed:https://eaglepubs.erau.edu/introductiontoaerospaceflightvehicles/chapter/introduction-to-boundary-layers/ (Year: 2022).*

(Continued)

*Primary Examiner* — Taras P Bemko
(74) *Attorney, Agent, or Firm* — Baker Hughes Company

(57) ABSTRACT

A system and method for shearing a fluid. The system includes a turbine having a rotational axis, a fluid inlet for receiving the fluid, a disk rotatable about the rotational axis at a selected speed, and a fluid outlet for expelling the fluid from the turbine. The fluid flows across a surface of the disk, and the disk shears the fluid as the fluid moves across a surface of the disk.

11 Claims, 6 Drawing Sheets

(56) References Cited

U.S. PATENT DOCUMENTS

| | | | | |
|---|---|---|---|---|
| 2001/0019693 | A1* | 9/2001 | Dial | F04D 29/2238 415/206 |
| 2011/0232909 | A1* | 9/2011 | Kapila | B01F 33/811 166/305.1 |
| 2023/0127681 | A1* | 4/2023 | Hussain | B02C 13/28 166/351 |

FOREIGN PATENT DOCUMENTS

| | | | |
|---|---|---|---|
| CN | 214577207 | U | 11/2021 |
| WO | 2021016284 | A1 | 1/2021 |

OTHER PUBLICATIONS

Discflo Disc Pumps Case Study; "Disc Pumps Godsend for Dredging"; Discflo Corporation; www.discflo.com; 11 pages.

International Search Report and Written Opinion; PCT/US2024/048268; Korean Intellectual Property Office; Mailed Dec. 24, 2024; 10 pages.

Raje, A., et al., "A Review of Tesla Turbine", International Journal of Mechanical Engineering and Technology: vol. 6, Issue 10, Oct. 2015, pp. 28-31.

* cited by examiner

HIGH EFFICIENCY DRILLING FLUID SHEARING PUMP USING STAGED TESLA TURBINE

BACKGROUND

In the resource recovery and fluid sequestration industries, a drill string is used to create a borehole in an earth formation. A drill bit at a downhole end of the drill string rotates, thereby creating cuttings. A drilling fluid or drilling mud is circulated through the drill string to exit into the borehole at a downhole end. The drilling fluid then flows uphole through an annulus to remove the cuttings from the borehole. Before being sent downhole, the drilling fluid can be treated with additives. Additives have a certain level of coarseness. The coarser the additive, the more they can wear on the drilling equipment. Therefore, it is generally desirable to have additives be as fine as possible. Accordingly, there is a need for a system and method for shearing the additives in the drilling fluid prior to circulation of the drilling fluid downhole.

SUMMARY

Disclosed herein is a method for shearing a fluid. A disk of a turbine is rotated at a selected speed. The fluid flows across a surface of the disk to shear the fluid. The fluid is expelled from the turbine at a fluid outlet of the turbine.

Also disclosed herein is a system for shearing a fluid. The system includes a turbine having a rotational axis, a fluid inlet for receiving the fluid, a disk rotatable about the rotational axis at a selected speed, wherein the disk shears the fluid as the fluid moves across a surface of the disk, and a fluid outlet at a circumferential location of the turbine for expelling the fluid from the turbine.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
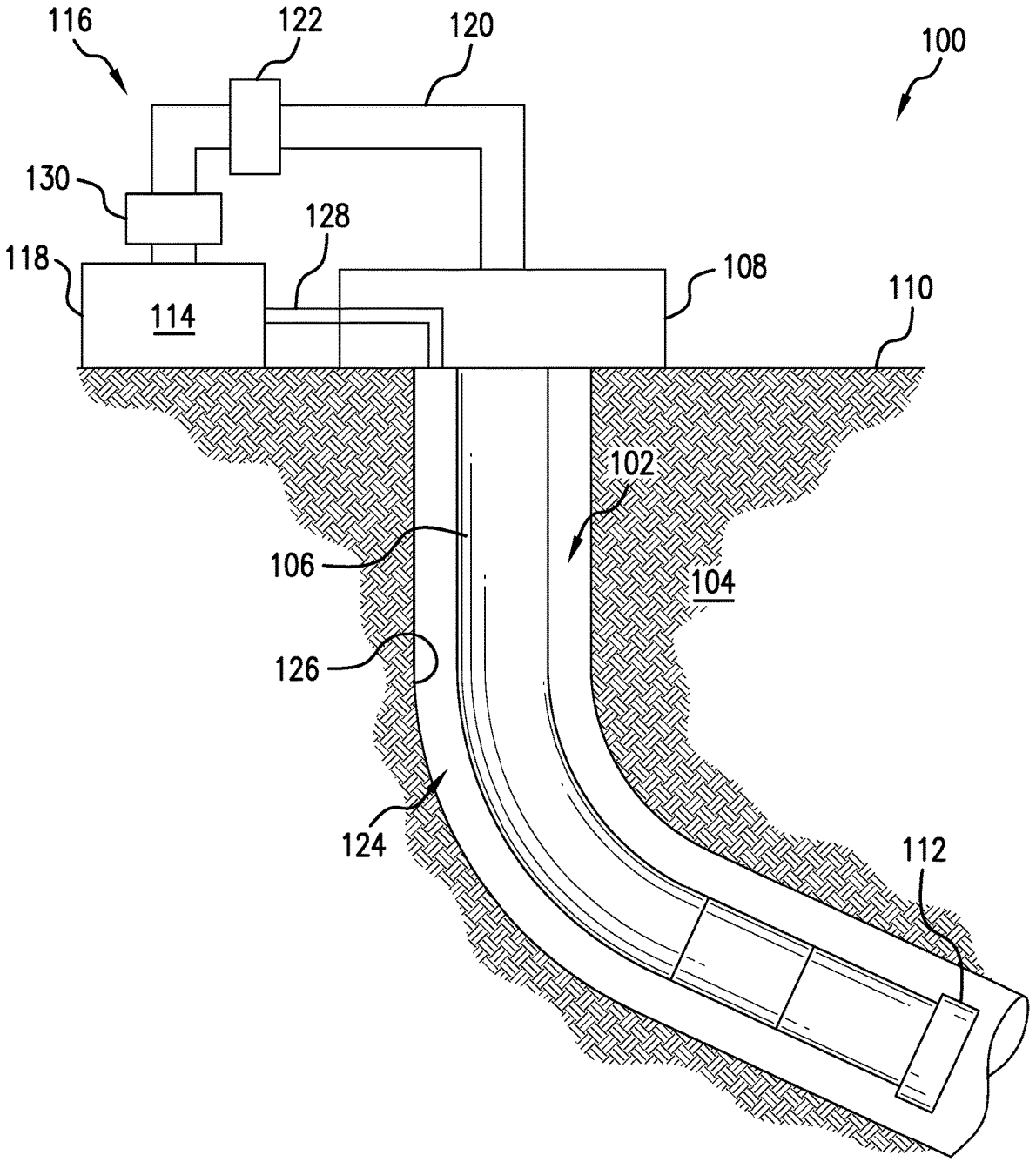
FIG. 1 shows a borehole system in an illustrative embodiment.

Referring to FIG. 1, a borehole system 100 is illustrated. The borehole system 100 comprises a borehole 102 formed in a subsurface formation 104. A drill string 106 extends from a platform 108 at a surface location 110 into the borehole 102. The drill string 106 includes a drill bit 112 at a bottom end that is used to drill the borehole 102 and which produces cuttings during the drilling operation. A drilling fluid 114 is circulated through the borehole 102 to remove the cuttings from the borehole 102.

A drilling fluid circulation system 116 includes a fluid storage device 118 that stores the drilling fluid 114 at the surface location 110 and an injection pipe 120 that extends from the fluid storage device 118 to a top end of the drill string 106. The injection pipe 120 includes a pump 122 for pumping the drilling fluid 114 from the fluid storage device 118 into the drill string 106. The drilling fluid 114 flows downhole through a central bore of the drill string 106 to exit into the borehole 102 at the drill bit 112. The drilling fluid 114 then flows to the surface through an annulus 124 between the drill string 106 and a wall 126 of the borehole 102. At the surface location 110, the drilling fluid 114 returns to the fluid storage device 118 via a return pipe 128.

The drill string 106 is an example of a work string suitable for use in the borehole 102. The methods disclosed herein are not limited to use with a drill string 106 and can be used with other types of work strings.

Additives can be included in the drilling fluid. The additives can be grains that can come in varying sizes, such as large and coarse or small and fine. A fluid shearing device 130 can be used to shear the drilling fluid (i.e., to break up the additives in the drilling fluid from coarse particles to fine particles). In one embodiment, the fluid shearing device 130 can be located in the injection pipe 120. In another embodiment, the fluid shearing device 130 can be located at a location that is independent of the drilling fluid circulation system 116 and can be used to shear the drilling fluid before the drilling fluid is placed in the fluid storage device 118.

Figure 2:
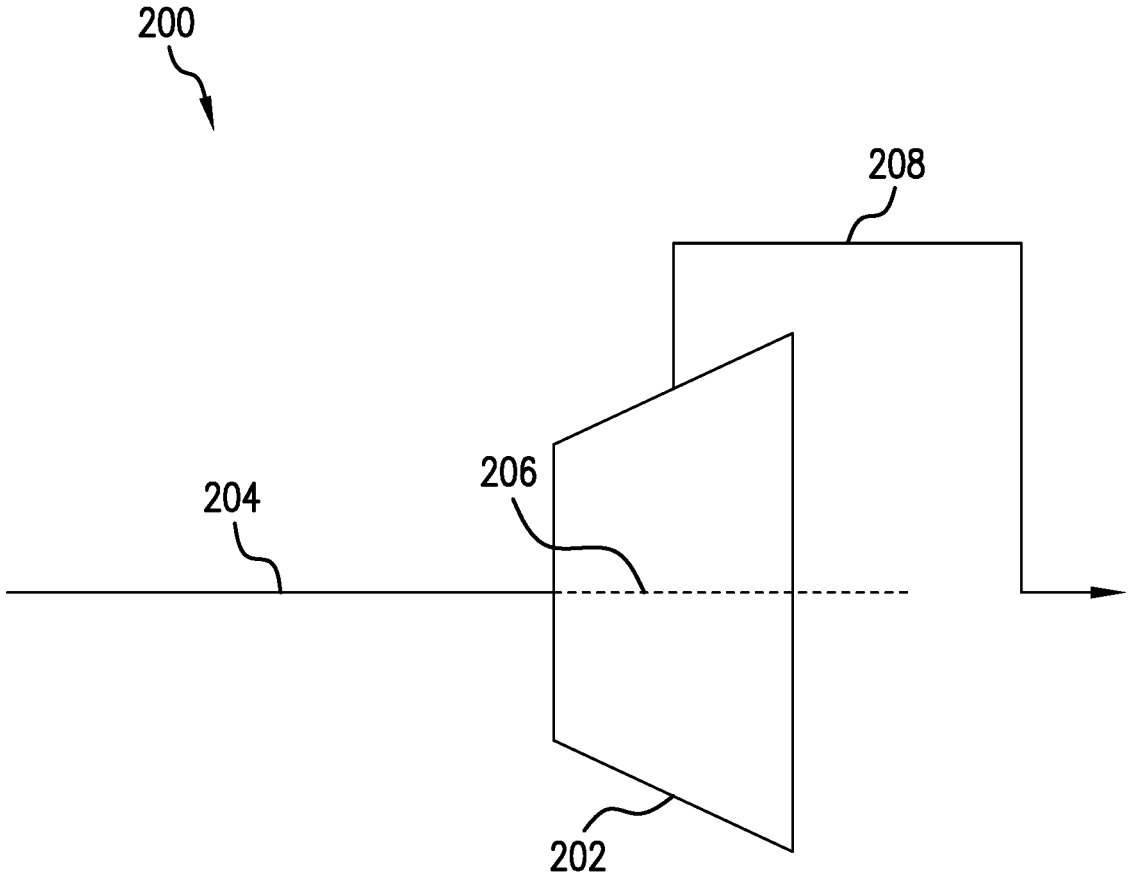
FIG. 2 shows diagram of the fluid shearing device in an illustrative embodiment.

FIG. 2 shows diagram 200 of the fluid shearing device 130 in an illustrative embodiment. The fluid shearing device 130 include a turbine 202, such as a Tesla turbine. A fluid inlet 204 injects fluid into the turbine along a rotational axis 206 of the turbine. The fluid exits the turbine 202 at a fluid outlet 208 located at a circumferential location of the turbine.

Figure 3:
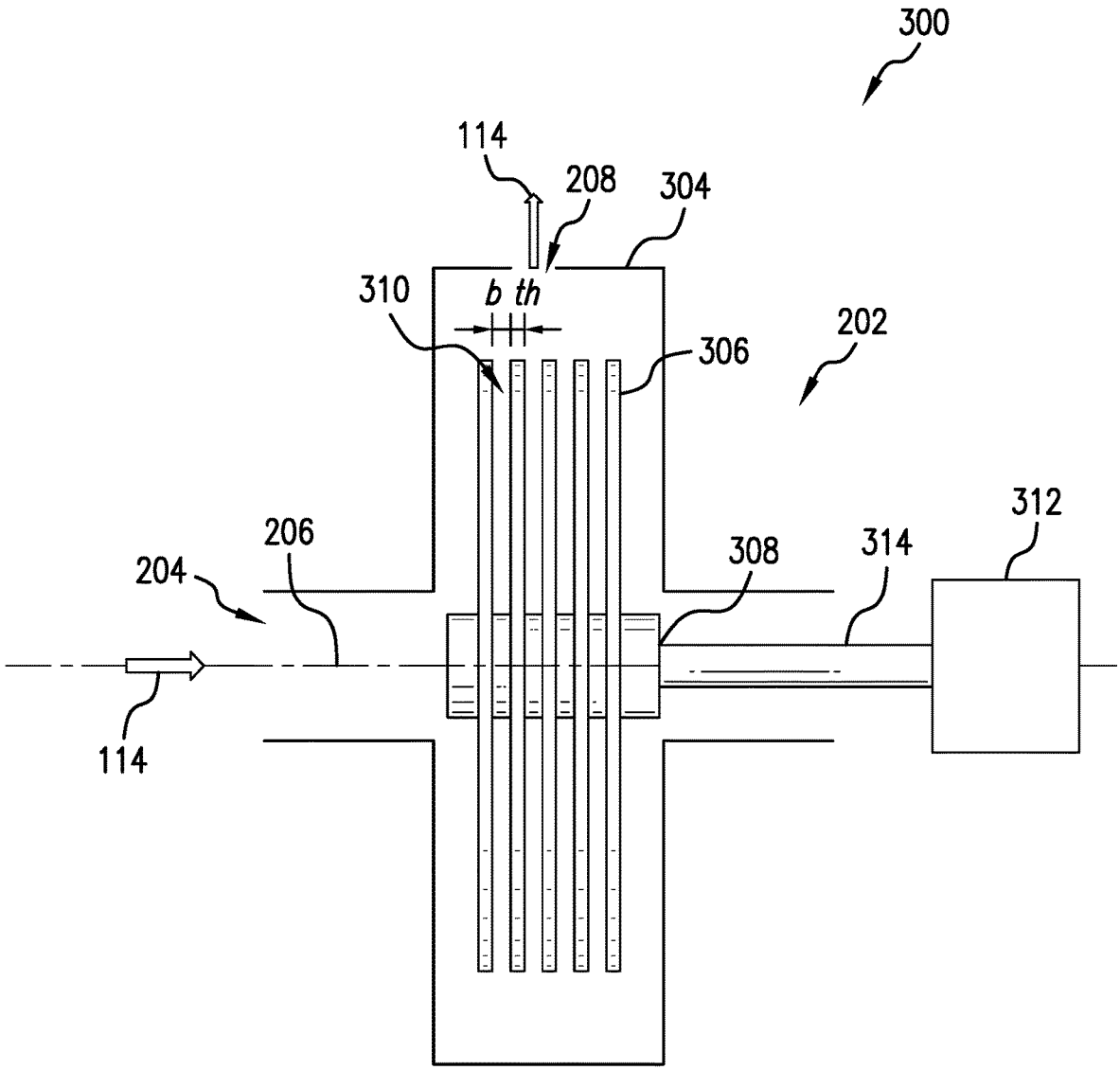
FIG. 3 shows a detailed view of the turbine in an illustrative embodiment.

FIG. 3 shows a detailed view 300 of the turbine 202 in an illustrative embodiment. The turbine 202 has a housing 304 that surrounds at least two disks 306 or plates disposed on a rotor 308. The at least two disks 306 include smooth surfaces along its radius. The at least two disks 306 are separated by a gap 310 therebetween having a known gap size. The rotor 308 is connected to a motor 312 via a rotor shaft 314. The motor 312 applies a torque on the rotor 308 to rotate the rotor 308 and the at least two disks 306 to rotate around a rotational axis 316. The fluid inlet 204 is located along the rotational axis 316 and the fluid outlet 320 is located along a circumferential location of the housing 304. The drilling fluid 114 is injected into the housing 304 at the fluid inlet 204 and flows parallel to the rotational axis and into the gap 310 between the at least two disks 306.

The at least two disks 306 impart a radially outward velocity on the drilling fluid 114 that is in the gap 310 by dragging the drilling fluid along their surfaces as the at least two disks 306 rotate. Fluid particles along a boundary layer of the fluid at the surfaces of the at least two disks 306 travels at a first velocity while fluid particles away from the surfaces travel at a second velocity. The difference in these velocities produces a shear stress within the drilling fluid 114. The shear stress is imparted to the additive particles, causing the additive particles to break up, disintegrate, or change from a having a first coarseness (e.g., coarse) to a second coarseness (e.g., fine). At the circumference of the at least two disks 306, the fluid exits the gap 310 and leaves the turbine 202 via the fluid outlet 320. The speed of rotation of the at least two disks 306 can affect the degree of shearing that occurs in the fluid. In various embodiments, the disks are rotated at a selected speed such as, for example, about 20,000 rotations per minute.

The fluid is sheared based on various forces. For example, due to the high velocity of rotation of the disk, the fluid and its additive particles are flung by the disk against the housing at high speeds, thereby shearing the fluid. Also, due to the width of the gap between the disks, the fluid has high internal friction between a boundary layer of the fluid and a layer away from the disks. This internal friction causes viscous bonding of the fluid to breaking, thereby shearing the fluid.

Figure 4:
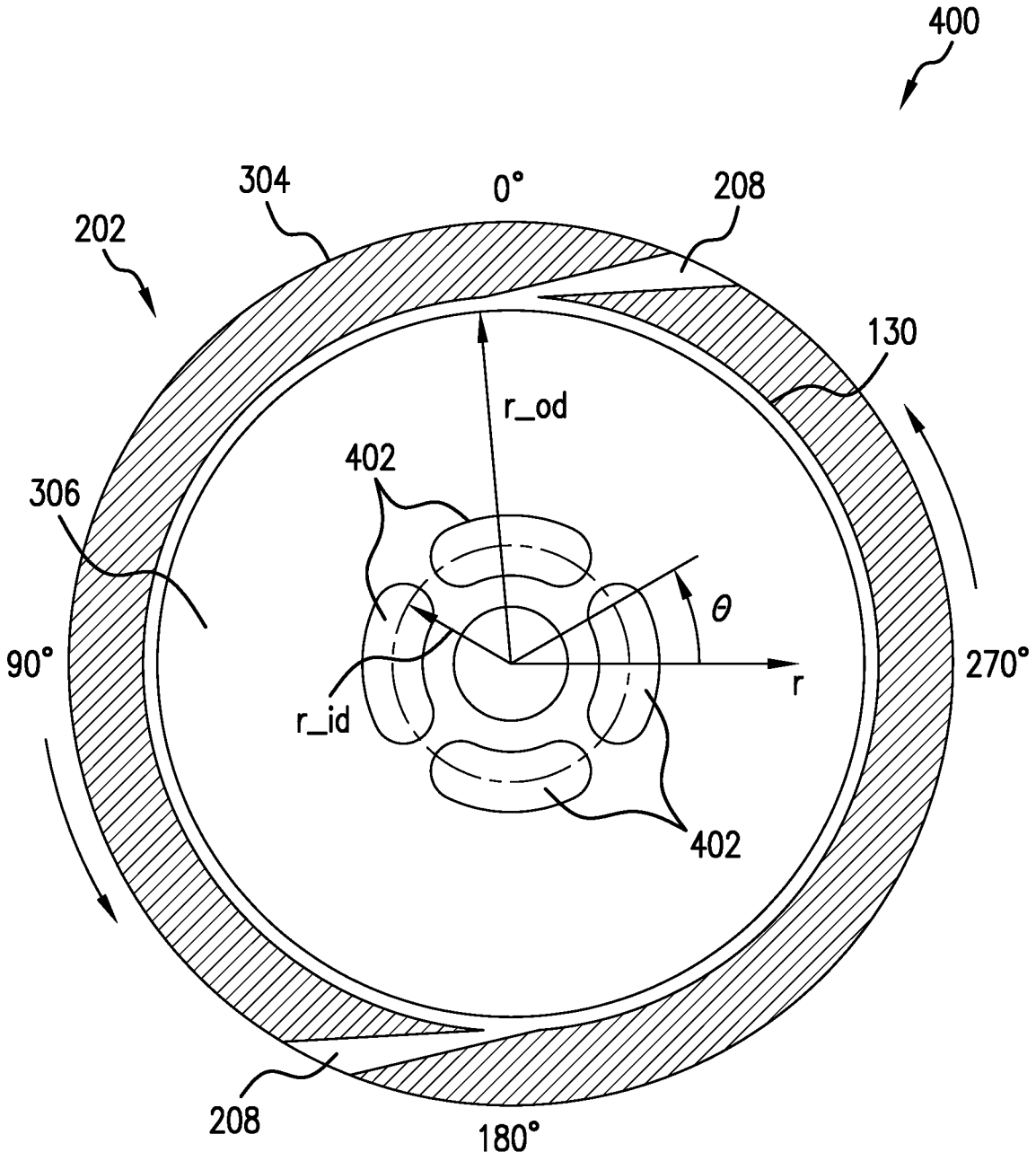
FIG. 4 shows a view of the turbine along the rotational axis.

FIG. 4 shows a view 400 of the turbine 202 along the rotational axis 206. The at least two disks 306 have openings 402 located near the center of the disks. The openings 402 allow fluid that is traveling along the rotational axis 206 to enter into the gap 310 to be diverted to flow radially outward along the surface of the at least two disks 306 in order to exit the turbine at the fluid outlet 208.

Figure 5:
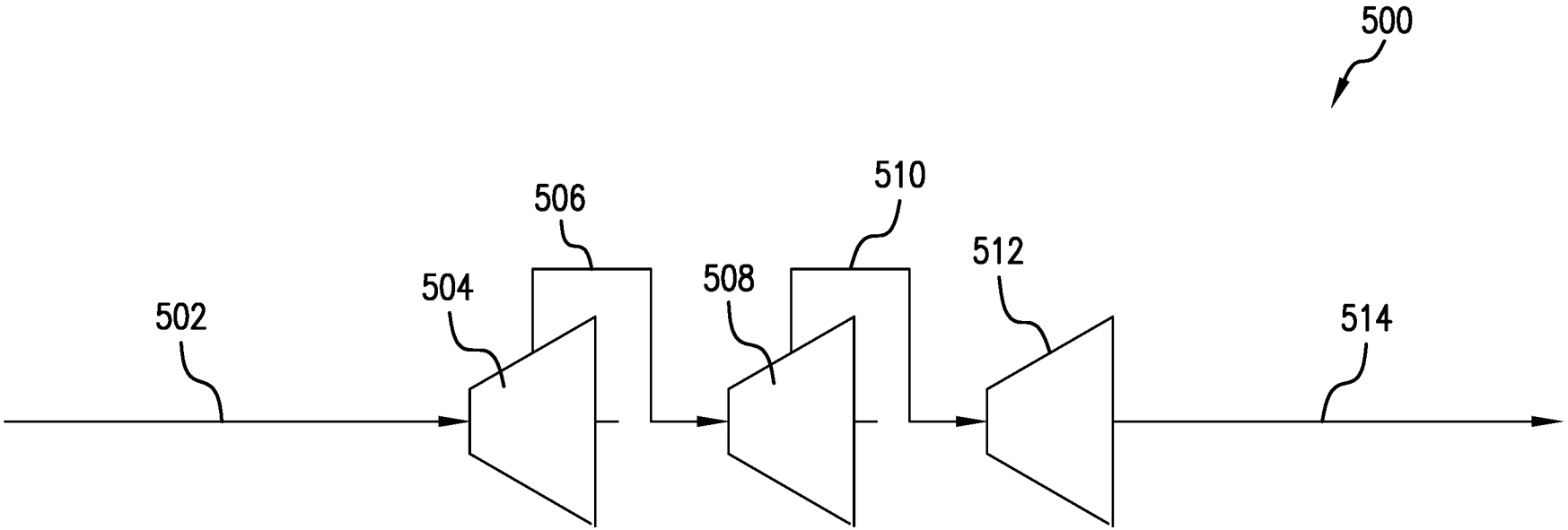
FIG. 5 shows a diagram of the shearing device in another embodiment.

FIG. 5 shows a diagram 500 of the fluid shearing device 130 in another embodiment. The fluid shearing device 130 include a plurality of turbines arranged sequentially. For illustrative purposes, three turbines are shown. A fluid line 502 directs fluid into a first turbine 504 along a rotational axis of the first turbine 504. The first turbine 504 performs a first shearing of the drilling fluid. The sheared fluid exits the first turbine 504 at a circumferential location of the first turbine and into a first transfer line 506. The fluid in the first transfer line 506 is directed into a second turbine 508 along a rotational axis of the second turbine 508. The second turbine 508 performs a second shearing of the drilling fluid. The sheared fluid exits the second turbine 508 at a circumferential location of the second turbine 508 and into a second transfer line 510. The fluid in the second transfer line 510 is directed into the third turbine 512 along a rotational axis of the third turbine 512. The third turbine 512 performs a third shearing of the drilling fluid. The sheared fluid exits the third turbine 512 at a circumferential location of the third turbine 512 and into a fluid output line 514.

Figure 6:
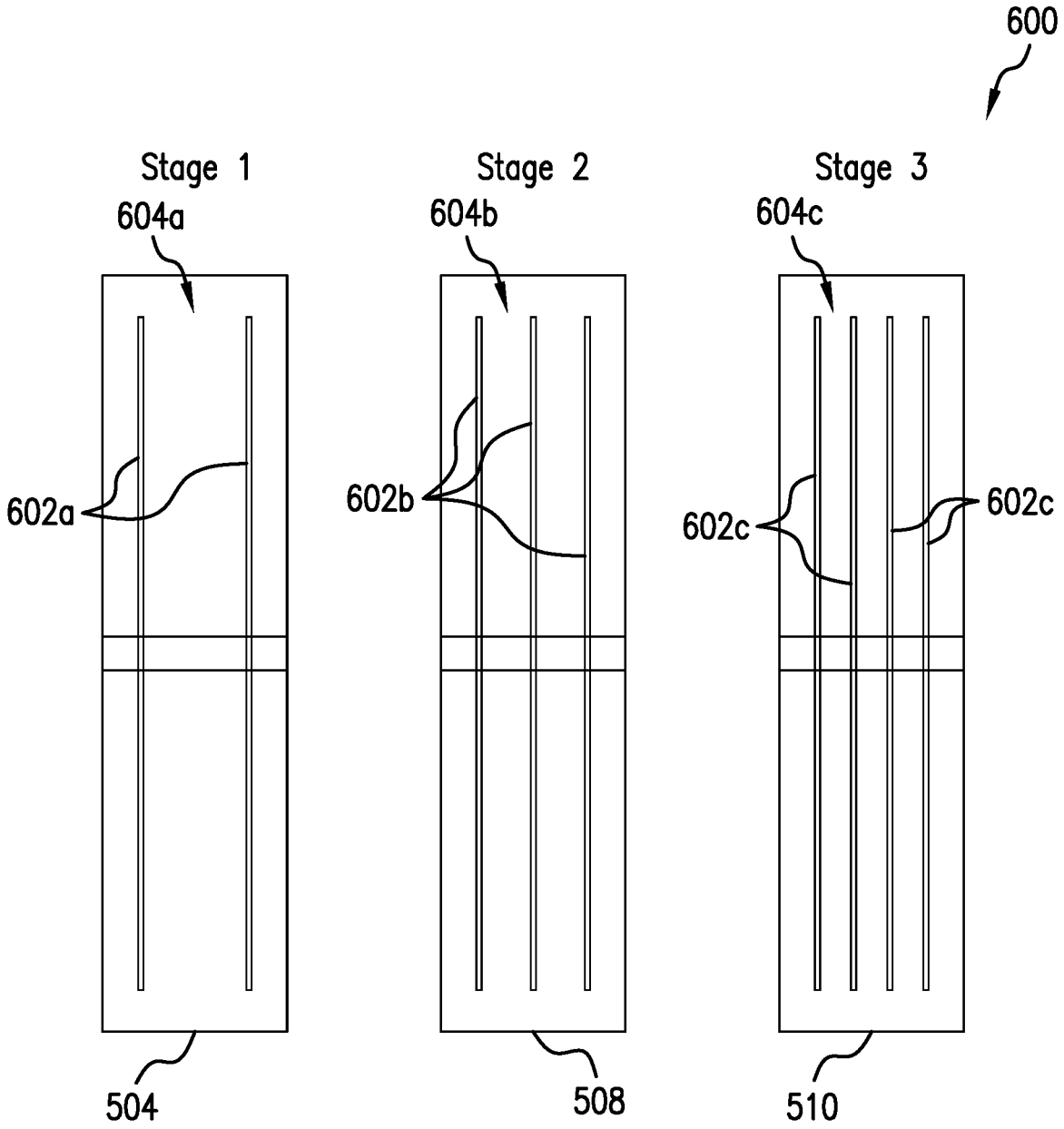
FIG. 6 shows detailed view of the turbines of FIG. 5.

FIG. 6 shows detailed view of the turbines of FIG. 5. The first turbine 504 includes a first set of disks 602*a* that are separated by a first gap 604*a* having a first separation distance. The second turbine 508 includes a second set of disks 602*b* that are separated by a second gap 604*b* having a second separation distance. The third turbine 512 includes a third set of disks 602*c* that are separated by a third gap 604*c* having a third separation distance. The first set of disks 602*a* shears the fluid a first time to a first level of coarseness which is related to the first separation distance of the first gap 604*a*. The second set of disks 602*b* then shears the fluid to a second level of coarseness that is finer than the first level of coarseness. The ability to perform finer shearing is due to the second separation distance of the second gap 604*b* being smaller than the first separation distance of the first gap 604*a*. Similarly, the third set of disks 602*c* shears the fluid to a third, even finer, level of coarseness due to the third separation distance being smaller than the second separation distance.

The fluid that is sheared by the methods disclosed herein is describes as a drilling fluid. In various embodiments, the fluid is any fluid that includes two or more components. A first component can be a first fluid, and a second component can be a second fluid or an additive or additive particle. In various embodiments, the fluid can be any type of fluid including, but not limited to, a drilling fluid, a frac fluid, a drill-in fluid, a packer fluid.

Set forth below are some embodiments of the foregoing disclosure:

Embodiment 1. A method for shearing a fluid. A disk of a turbine is rotated at a selected speed. The fluid flows across a surface of the disk to shear the fluid. The fluid is expelled from the turbine at a fluid outlet of the turbine.

Embodiment 2. The method of any prior embodiment, wherein the disk includes at least two disks.

Embodiment 3. The method of any prior embodiment, further including flowing the fluid into the turbine along a rotational axis of the turbine, wherein rotating the disk imparts a radially outward velocity to the fluid.

Embodiment 4. The method of any prior embodiment, wherein the fluid has an additive particle, further including shearing the fluid by dragging the particle along the surface of the disk via rotation of the disk to disintegrate the additive particle.

Embodiment 5. The method of any prior embodiment, further including injecting the fluid expelled from the turbine into one of: (i) a storage device; and (ii) a drill string.

Embodiment 6. The method of any prior embodiment, wherein the fluid includes an additive particle and the turbine includes a first turbine and a second turbine, the first turbine includes a first set of disks defining a first gap having a first separation distance and the second turbine includes a second set of disks defining a second gap having a second separation distance less than the first separation distance, further including injecting the fluid into the first turbine to obtain a first level of coarseness of the additive particle and injecting the fluid from the first turbine into the second turbine obtain a second level of coarseness of the additive particle.

Embodiment 7. The method of any prior embodiment, wherein the fluid is one of: (i) a drilling fluid, (ii) a frac fluid, (iii) a drill-in fluid, and (iv) a packer fluid.

Embodiment 8. A system for shearing a fluid. The system includes a turbine having a rotational axis, a fluid inlet for receiving the fluid, a disk rotatable about the rotational axis at a selected speed, wherein the disk shears the fluid as the fluid moves across a surface of the disk, and a fluid outlet at a circumferential location of the turbine for expelling the fluid from the turbine.

Embodiment 9. The system of any prior embodiment, wherein the disk includes at least two disks.

Embodiment 10. The system of any prior embodiment, wherein the disk is configured to impart a radially outward velocity to the fluid.

Embodiment 11. The system of any prior embodiment, wherein the fluid is a drilling fluid having an additive particle, further including shearing the drilling fluid by dragging the additive particle along the surface of the disk via rotation of the disk to disintegrate the additive particle.

Embodiment 12. The system of any prior embodiment, wherein the fluid outlet is configured to transfer the fluid from the turbine into one of: (i) a storage device; and (ii) a drill string.

Embodiment 13. The system of any prior embodiment, wherein the turbine includes a first turbine and a second turbine, the first turbine includes a first set of disks defining a first gap having a first separation distance and the second turbine includes a second set of disks defining a second gap having a second separation distance less than the first separation distance, and a fluid transfer line between a fluid outlet at the circumferential location of the first turbine to an inlet along the rotational axis of the second turbine.

Embodiment 14. The system of any prior embodiment, wherein the fluid includes an additive particle and rotation of the first set of disks obtains a first level of coarseness of the additive particle and rotation of the second set of disks injecting the fluid from the first turbine into the second turbine obtain a second level of coarseness of the additive particle.

Embodiment 15. The system of any prior embodiment, wherein the fluid includes at least a first component including a first fluid and second component, the second component includes one of: (i) a second fluid; and (ii) an additive particle.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for shearing a particle within a fluid, comprising:

rotating a disk of a turbine at a selected speed;

flowing the fluid across a surface of the disk to create a shear stress within the fluid due to a difference between a first fluid velocity at a boundary layer of the disk and a second fluid velocity at a distance from the disk;

imparting the shear stress to the additive particle within the fluid to disintegrate the additive particle; and expelling the fluid from the turbine at a fluid outlet of the turbine.

2. The method of claim 1, further comprising flowing the fluid into the turbine along a rotational axis of the turbine, wherein rotating the disk imparts a radially outward velocity to the fluid.

3. The method of claim 1, further comprising shearing the fluid by dragging the particle along the surface of the disk via rotation of the disk to disintegrate the additive particle.

4. The method of claim 1, further comprising injecting the fluid expelled from the turbine into one of: (i) a storage device; and (ii) a drill string.

5. The method of claim 1, wherein the fluid is one of: (i) a drilling fluid, (ii) a frac fluid, (iii) a drill-in fluid, and (iv) a packer fluid.

6. A system for shearing an additive particle within a fluid, comprising:

a turbine having a rotational axis;

a fluid inlet for receiving the fluid;

a disk rotatable about the rotational axis at a selected speed, wherein the disk rotates to create a shear stress within the fluid due to a difference between a first fluid velocity at a boundary layer of the disk and a second fluid velocity at a distance from the disk, wherein the shear stress is imparted to the additive particle within the fluid to disintegrate the additive particle; and a fluid outlet at a circumferential location of the turbine for expelling the fluid from the turbine.

7. The system of claim 6, wherein the disk is configured to impart a radially outward velocity to the fluid.

8. The system of claim 6, wherein the fluid is a drilling fluid, further comprising shearing the drilling fluid by dragging the additive particle along the surface of the disk via rotation of the disk to disintegrate the additive particle.

9. The system of claim 6, wherein the fluid outlet is configured to transfer the fluid from the turbine into one of: (i) a storage device; and (ii) a drill string.

10. The system of claim 6, wherein the fluid comprises at least a first fluid and a second fluid.

11. The method of claim 1, wherein the disk is rotated at a speed of about 20,000 rotations per minute.

* * * * *